US005419089A

United States Patent [19]

Hill

[11] Patent Number: 5,419,089

[45] Date of Patent: May 30, 1995

[54] APPARATUS AND METHODS FOR IMPROVED CONSTRUCTION

[76] Inventor: Lionel D. Hill, 68 Mather Street, Garbutt, Townsville, Queensland 4818, Australia

[21] Appl. No.: 945,851

[22] Filed: Sep. 16, 1992

[51] Int. Cl.[6] ..... E04B 7/02; E04C 2/38

[52] U.S. Cl. ..... 52/93.2; 52/93.1; 52/656.9

[58] Field of Search ..... 52/90.1, 93.1, 93.2, 52/92.2, 656.9

[56] References Cited

U.S. PATENT DOCUMENTS

| | | | |
|---|---|---|---|
| 3,362,736 | 1/1968 | Halle | 52/93.1 |
| 3,771,269 | 11/1973 | Lerch et al. | 52/93.2 |
| 4,201,019 | 5/1980 | Jones | 52/93.1 |
| 4,231,198 | 11/1980 | Augier et al. | 52/93.1 |
| 4,930,268 | 6/1990 | Fritz et al. | 52/93.2 |
| 4,974,387 | 12/1990 | Dufour | 52/93.1 |

FOREIGN PATENT DOCUMENTS

| | | | |
|---|---|---|---|
| 2142278 | 3/1973 | Germany | 52/93.1 |
| 8703634 | 6/1987 | WIPO | 52/93.2 |

*Primary Examiner*—Neill R. Wilson

*Attorney, Agent, or Firm*—Gerstman, Ellis & McMillin, Ltd.

[57] ABSTRACT

Steel framing is provided for a building construction having a roof structure [80] and perimeter supporting posts [89] of roll formed steel sections. The connections between the perimeter posts [89] and the roof structure [80] are formed by separate connector assemblies [60] each having post mounting brackets [63] enabling each connector [60] to be bolted to the top of a respective the perimeter post [89], roof frame mounting brackets [61] enabling each connector to be bolted to a respective inclined roof frame member [92] extending inwardly from the respective perimeter posts [89], and perimeter beam mounting brackets [64] enabling adjacent perimeter posts [89] to be interconnected by perimeter beams [91] bolted to the perimeter beam mounting brackets [60].

10 Claims, 10 Drawing Sheets

FIG. 3a
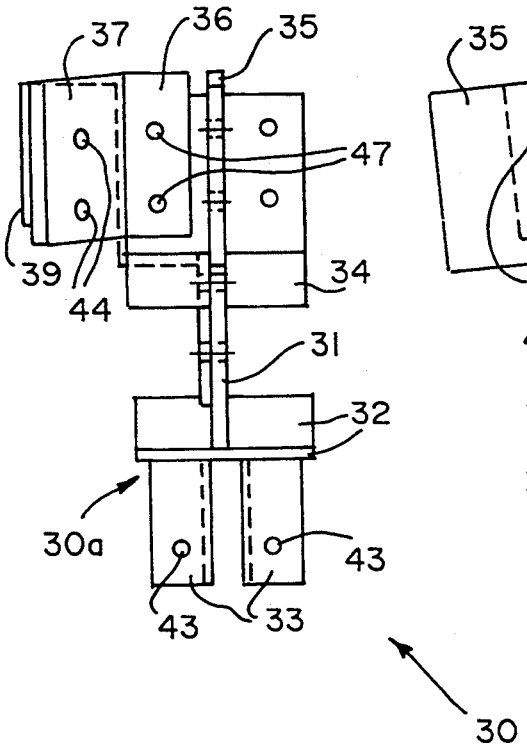
FIG. 3b
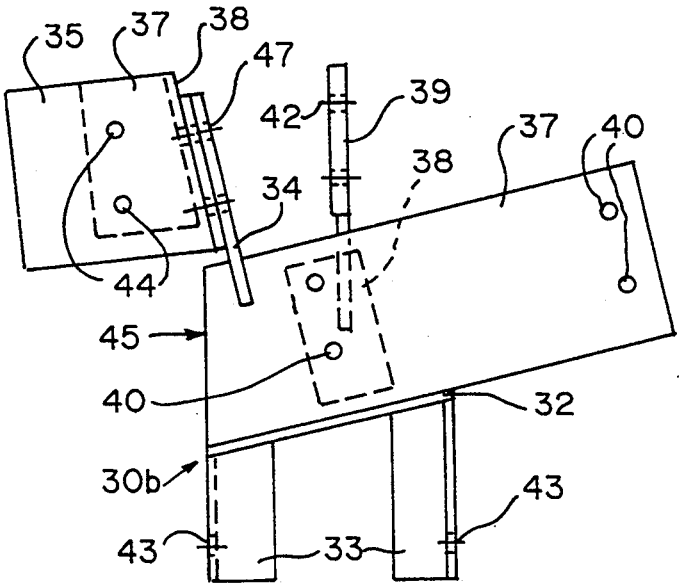
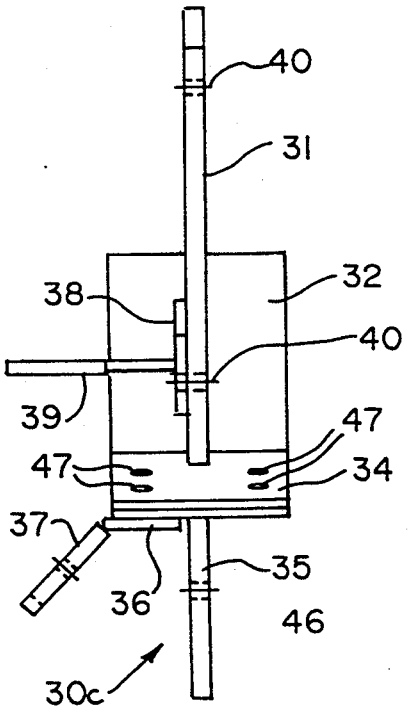
FIG. 3c

TYPE 3 UTILZED AS SUPPORT FOR INTERNAL LINING

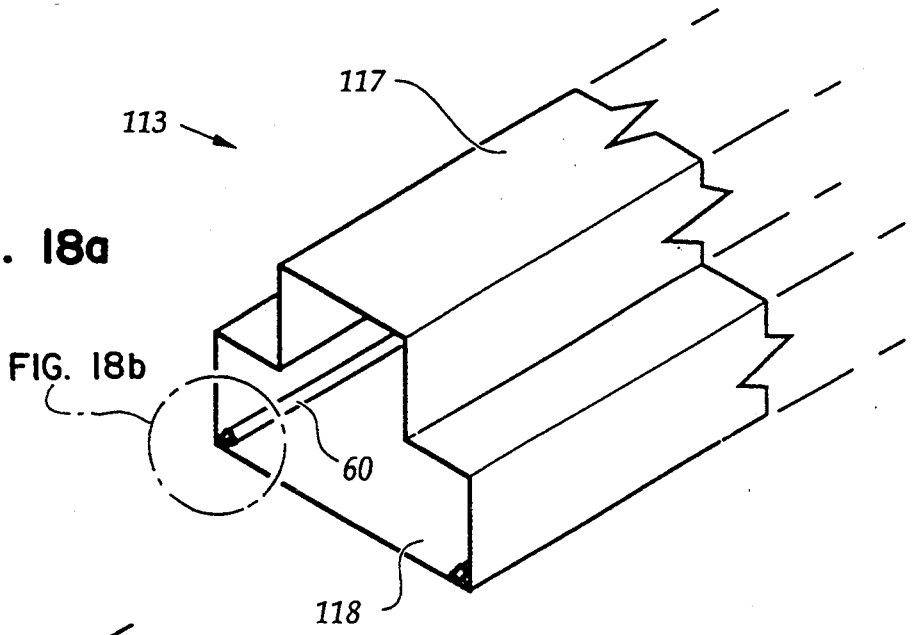
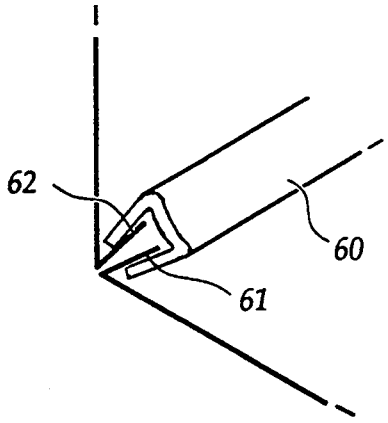
FIG. 18b
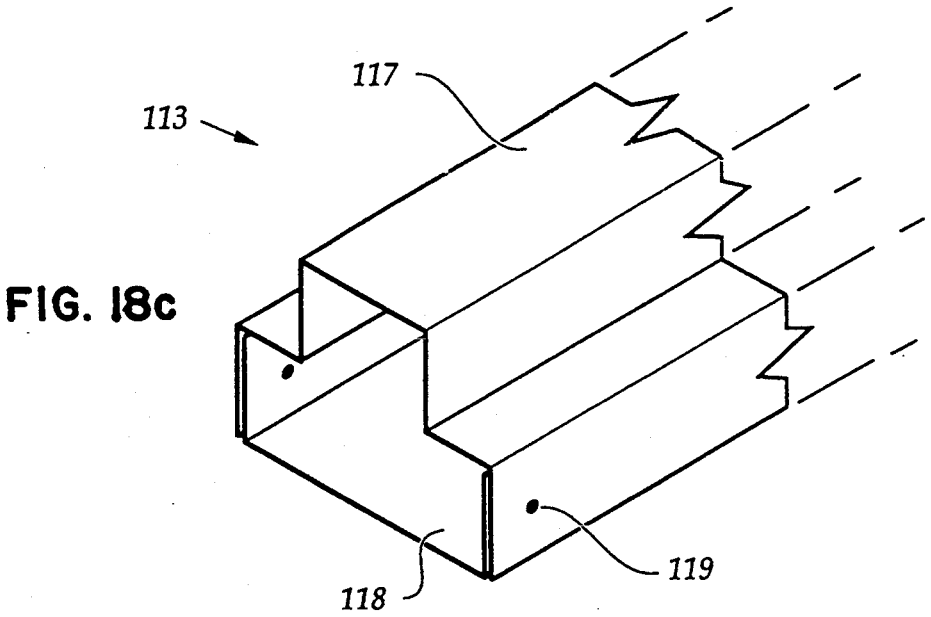

APPARATUS AND METHODS FOR IMPROVED CONSTRUCTION

BACKGROUND OF THE INVENTION

This invention relates to an improved construction.

In particular this invention relates to a construction suitable for erecting low cost dwellings. More generally, the construction of the present invention may be used in other applications such as garages and industrial and commercial buildings.

In order to provide low cost accommodation, many people elect to erect kit-built homes. Such homes are generally formed as a fixed layout and do not provide the owner with flexibility for the interior arrangement as well as the arrangement of doors, windows and verandas and the like.

Furthermore, where kit-built homes are provided using steel frames, there are a large number of components, including general purpose connectors for connecting one steel section to another steel section, joiner component or such like. Frequently, a special piece has to be fabricated to permit walls, floors, ceilings and roofs to be joined together and/or finished.

Furthermore, the cost of erecting many buildings is significantly affected by the cost of transporting the building components to the site. This cost is often relatively high because building materials are often bulky to transport and shipping costs often relate to the volume of material shipped rather than the weight.

The present invention aims to alleviate at least one of the abovementioned disadvantages and to provide an improved construction which will be reliable and efficient in use. Other advantages of this invention will hereinafter become apparent.

SUMMARY OF THE INVENTION

With the foregoing and other objects in view, this invention in one aspect resides broadly in steel framing for a building construction having a roof structure including inclined roof frame members and perimeter supporting posts, characterised in that:

said posts and said roof structure is formed from roll formed steel sections;

the connections between the perimeter posts and the roof structure are formed by separate connector assemblies each having post mounting brackets enabling each connector to be mechanically fastened to the top of a respective said perimeter post and roof frame mounting brackets enabling each connector to be bolted to a respective inclined roof frame member extending inwardly from the respective perimeter posts, and said connector assemblies also having perimeter beam mounting brackets enabling adjacent perimeter posts to be interconnected by perimeter beams mechanically fastened to said perimeter beam mounting brackets.

The roof structure may be terminated at the peripheral edge of the respective perimeter posts, but preferably, the roof frame mounting brackets are be so formed that the frame member or a frame extension member may extend over and beyond the perimeter post. The posts may be rolled hollow section, I-beams, girders or such like, but preferably, the posts are formed as box-like members and each said connector assembly includes a spigot/socket mounting extending into/over the end of a post and forming the post mounting bracket, an upstanding plate-like roof frame mounting bracket against which a side face of the inclined roof frame member may extend, and the plate-like roof frame mounting brackets having detachable mounting means thereon for selectively attaching said perimeter beam mounting brackets thereto.

In a further preferred embodiment, the connector assembly includes a further mounting brackets for detachably securing extension roof frame members extending externally of said perimeter posts. The roof frame mounting brackets and the further mounting brackets extend inwardly from the outer face of the respective perimeter post whereby external cladding may extend upwardly beyond the perimeter posts to the underside of roofing material supported by said roof structure.

The box-section posts are formed by interconnecting the lips of complementary lipped channel members and the lips are interconnected by channel shaped splines slid over said lips.

Additionally, the building construction preferably includes external and/or internal walls and wherein said walls include spaced horizontally extending top, bottom and intermediate frame members and cladding secured to opposite sides of said horizontal frame members. In a preferred form the present invention aims to utilise commercially available roll-formed sections as structural components which may be factory cut and/or hole-punched to desired configurations.

Preferably each roof frame members is formed by a pair of channel section girders, attachable to the plate-like roof frame mounting bracket by connecting the channels back to back on each side of the plate-like roof frame mounting bracket.

Preferably the mounting brackets are each provided with at least two spaced apertures and the building construction elements mechanically fastened thereto are correspondingly apertured to permit mechanical fastening by bolting and forming moment transferring connections between the building construction elements and the connector assembly.

In another aspect, this invention resides broadly in a composite elongate hollow section including opposed lipped channel members arranged with the respective spaced lips of one lipped channel member opposing the spaced lips of the other lipped channel member and connecting means operatively interconnecting said opposing lips. Preferably the connecting means are channel shaped splines slid over said opposing lips. The lips may be external lips but preferably the lips are inwardly directed lips.

It is also preferred that the included angle between the lips and their integral side wall is an acute angle and that the connecting splines include a base wall and opposing side walls convergent from the base wall. Preferably the arrangement is such that the proximal edges of the opposed lips are clamped together by the respective splines and the peripheral edges of the opposed lips are restrained against rotation within the respective splines.

The composite member may also be provided with bulkheads which may be slid into position within the composition hollow section and fastened to the opposing lipped channel sections by screws or rivets or the like. The lipped channel sections may be pre-drilled for this purpose. The bulkhead may be in the form of a transverse frame of stiffener, but preferably is in the form of a plate adapted to substantially span the cross-sectional area within the composite section.

Preferably each roof frame members is formed by a pair of channel section girders, attachable to the plate-like roof frame mounting bracket by connecting the channels back to back on each side of the plate-like roof frame mounting bracket.

BRIEF DESCRIPTION OF THE DRAWINGS

In order that this invention may be more readily understood and put into practical effect, reference will now be made to the accompanying drawings which describe a preferred embodiment of this invention and wherein:

FIGS. 3*a*, 3*b*, and 3*c* collectively show the side, plan and end views of the connector assembly with frame extension supports attached;

DESCRIPTION OF THE PREFERRED EMBODIMENTS

Figure 1:
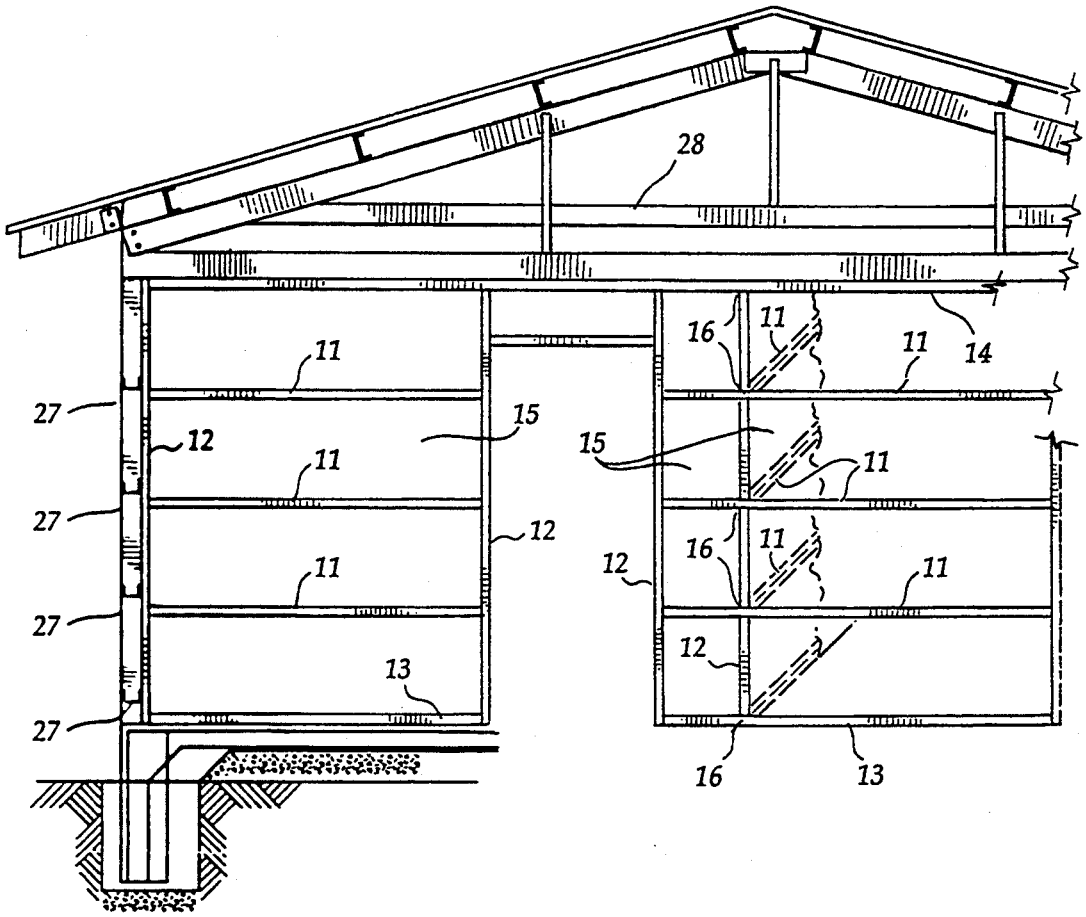
FIG. 1 is a schematic view of a steel frame construction.
Figure 2:
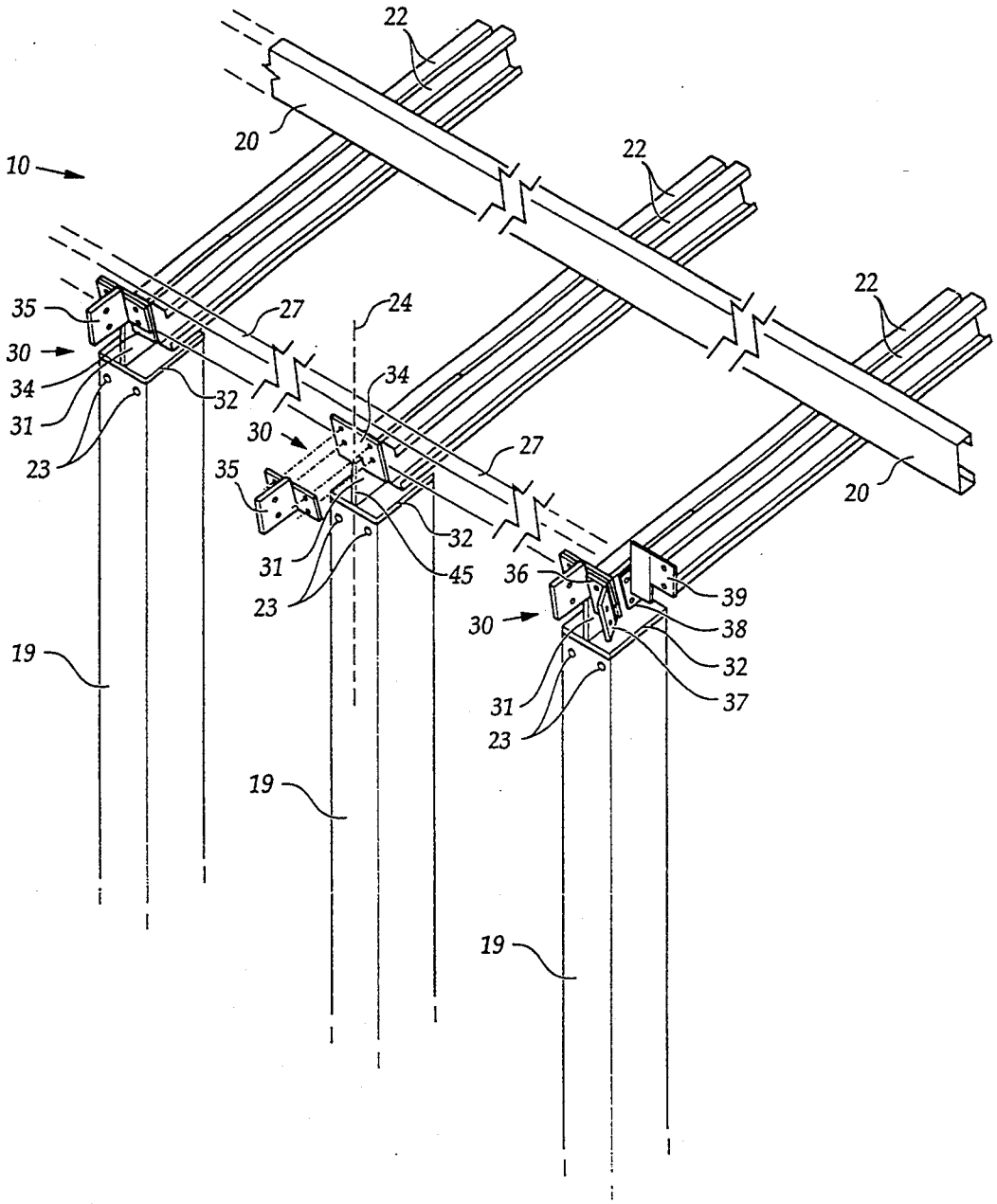
FIG. 2 is a diagrammatic view of the steel framing construction of FIG. 1 showing an arrangement for the connector assembly.

Referring to FIGS. 1 and 2, a building frame 10 includes the girts 27 of a conventionally constructed house frame. An internal wall frame 15 includes a plurality of horizontal studs 11 extending between respective vertical posts 12 and evenly spaced between a bottom plate 13 and a top plate 14. The horizontal studs 11, vertical posts 12, bottom plate 13 and top plate 14 are preferably roll-formed from galvanised steel into a channel section.

Where one internal wall frame 15 intersects with another, it is fastened thereto by fasteners at each intersection point 16. The fastening may be by any type of fastening, such as bolt, screw, rivet. The intersection points 16 may be welded, but this is not preferred because welding would damage the galvanising in the preferred material of construction.

Referring to FIG. 3, a haunch connector 30 is shown in three exemplifying forms fastened to respective perimeter posts 19. The haunch connector 30 includes a rafter plate 31 and a cap plate 32 is welded to the lower side of the rafter plate 31 towards the lower end and has four stud connector stubs 33 (not visible in FIG. 2 but shown in FIG. 3) welded on the under side and depending vertically downwards when the rafter plate 31 is oriented in its correct angle. The haunch connector 30 is connected to a perimeter post by providing fasteners 23 through pre-formed apertures in the perimeter post 19 and respective stud connector apertures 43.

A support stub 34 is welded in a saddle like orientation over the edge of the rafter plate 31 as shown in FIGS. 2 and 3. The faces of the support stub 34 are oriented at right angles to the upper edge of the rafter plate 31. The rafter plate 31 has a straight end 45 which is in substantial alignment with the vertical edge of stud connector stubs 33 which are closer to the end of the rafter plate 31 as shown. The support stub 34 is spaced from the straight end 45 so that its upper edge is in substantial alignment with the straight end 45 as a straight edge indicated by the line 24.

The haunch connector 30 thus described may be used for structures which do not have eaves or verandas. Wall sheeting attached to the outside wall passes over the straight end 45 substantially in alignment with the straight edge 24 and may extend without interruption to roof sheeting which is laid upon purlins or battens extending across rafters which are fixed to respective rafter plates 31. Without limiting the scope of this invention, it is believed that this arrangement provides for substantial vermin proofing of a structure so constructed.

Each rafter plate 31 has a pair of rafters 22 fastened thereto in back-to-back relationship, the respective adjacent webs of the rafters 22 being spaced apart from each other by the thickness of the rafter plate 31. The gap thus created permits a plate to be inserted and fastened between adjacent rafters 22 for providing other structural elements such as a stringer or tie beam 28, as well as bracing or such like to permit the construction of a truss or the like construction.

The support stub 34 is used to support perimeter beams 21 which together with a plurality of parallel and spaced apart purlins 20 may be used to support roof sheeting.

Referring to FIG. 3, the haunch connector 30 of FIG. 2 is shown in end view 30*a*, side view 30*b* and plan view 30*c*. The body of the haunch connector 30 is a rafter plate 31 having four rafter plate apertures 40 drilled therethrough as shown. A cap plate 32 is welded to the lower side of the rafter plate 31 towards the lower end and has four stud connector stubs 33 welded on the under side and depending vertically downwards when the rafter plate 31 is oriented in its correct angle.

Where the haunch connector 30 is provided in a straight wall and a veranda or eaves are required then a straight connector stub 35 may be attached to the support stub 34 by providing fasteners through support stub apertures 41.

Where the haunch connector 30 is used for a frame on the corner of a structure, and a veranda or eaves are required then a right connector stub 39 may also be attached to the rafter plate 31 by providing fasteners through two rafter plate apertures 40 as shown through to a right connector plate 38 which supports the right connector stub 39. If required, an angled connector stub 37 may also be attached to the support stub 34 by providing fasteners through two of the support stub apertures 41 as shown which attach an angled connector plate 36 which supports the angle connector stub 37.

The angle connector stub 37 shown is at 45° to the rafters 22, but other angles may be provided so that several angle connectors at evenly spaced angles are provided.

Veranda and/or eave rafters are attachable to the straight connector stub 35, the angle connector stub 37 and/or the right connector stub 39 through straight connector apertures 46, angled connector apertures 44 and right connector apertures 42 respectively as required.

Where a haunch connector 30 includes a straight connector stub 35, wall sheeting may be applied to the outer wall of a structure as described above but a slot is provided in the sheeting of a size to provide clearance around the straight connector stub 35 and still retain substantial vermin proofing of the structure so erected. Thus, when veranda or eave rafters are attached to the straight connector stub 35, the sheeting may be interposed between the ends of the veranda or eave rafters and the support stub 34. Similarly, the sheeting may be cut around the connector stubs 35, 37 and/or 39 as required.

Figure 4:
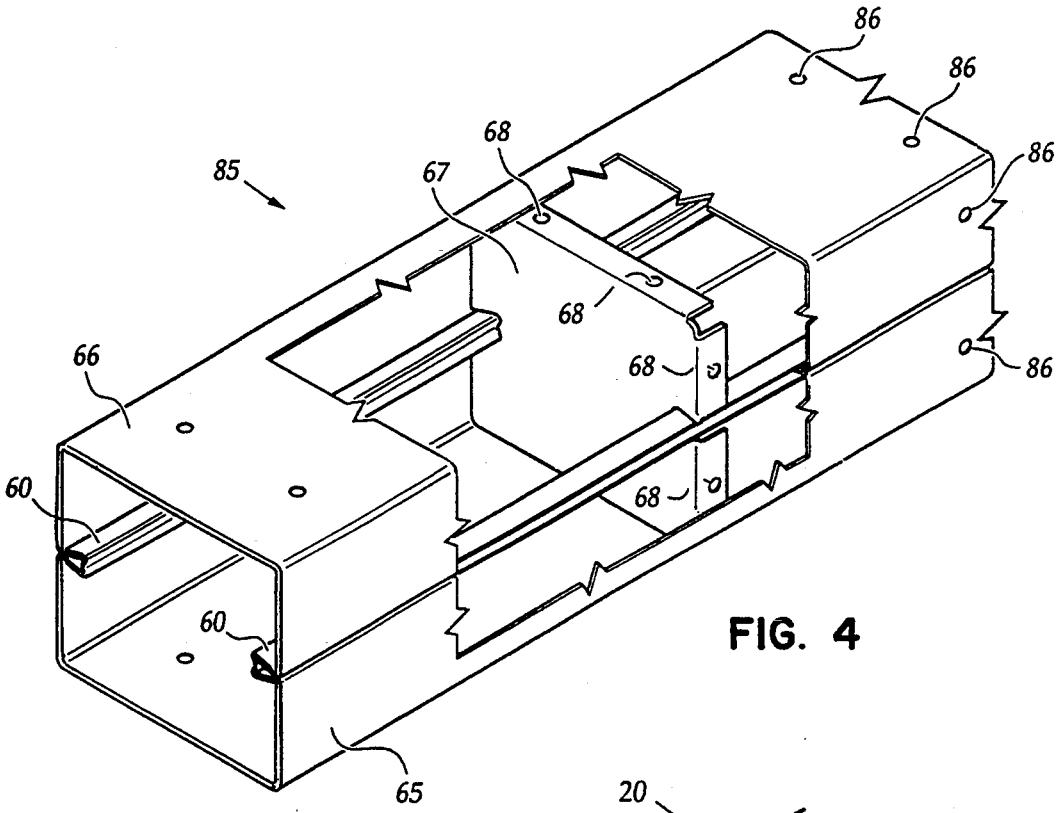
FIG. 4 is a broken away view of a composite box section having a bulkhead spaced along its length.
Figure 5:
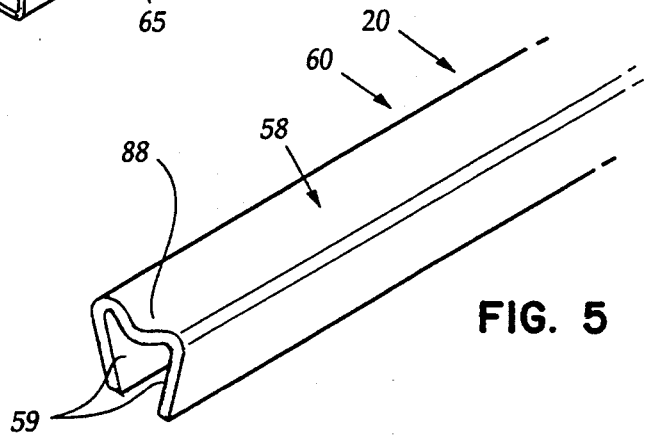
FIG. 5 is a view of the top, one side and one end of a spline according to another embodiment of this invention.
Figure 6:
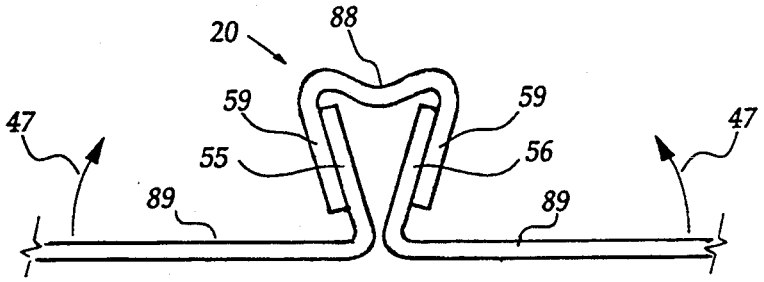
FIG. 6 is an end view showing the operation of the spline shown in FIG. 5.

Referring to FIGS. 4, 5 and 6, a composite box section post or member 85 is constructed from a channel section 65 and an oppositely arranged channel section 66 connected together about each of their longitudinal lipped edges by a spline member 60.

The spline member 60 includes a web portion 58 and two flange portions 59. The inner faces of the flange portions 59 engage with the inner faces of the lower lips 55 and 56. The spline 57 may be a loose or tight fit, but preferably is an interference or spring fit.

A bulkhead member 67 (one of which is shown for clarity), is fixed to the respective channel section 65 and the oppositely arranged channel section 66 by fasteners 86 through fixing apertures 68 as shown particularly in FIG. 4.

Referring to FIGS. 5 and 6, the spline member 60 includes a web portion 58 and two flange portions 59. The inner faces of the flange portions 59 engage with the inner faces of the loweor lips 55 and 56 in a similar manner to that shown in FIG. 4. The spline member 60 may be a loose or tight fit, but preferably is an interference or spring fit.

The web portion 58 of the spline member 60 further includes a spline groove 88, so that, as shown in FIG. 6, where two connected panels 89 are joined together by the spline member 60 the spine groove 88 substantially prevents the connected panels 89 from rotating about the joint in the direction of arrows 47. As is the case with the spline 57, the spline member 60 substantially prevents rotation of the connected panels 89 about the joint in the opposite direction of arrows 47 by engagement of the lips 55 and 56 against the flange portion 59. Accordingly in use the outer adjoining faces of the connected panels are maintained in co-planar alignment.

An advantage of the present construction is that if access to the hollow of the box section 50 is required, then the upper lips 53 and 54 may be prised apart. Once access is no longer required the spring action of the lower lips 55 and 56 and/or the elongate clamping means cause the upper lips 53 and 54 together.

The elongate clamping means may be fixed to the lips by engaging one end of the elongate clamping means with one end of the channel sections and forcing the elongate clamping means axially along the lips to the other end of the channels so that the elongate clamping means engages the entire length of the channel sections. Alternatively, the elongate clamping means may be placed over the lower lips and forced to engage the lips transversely. Of course, a plurality of shorter length elongate clamping means may be used along the length of channel sections.

Figure 7:
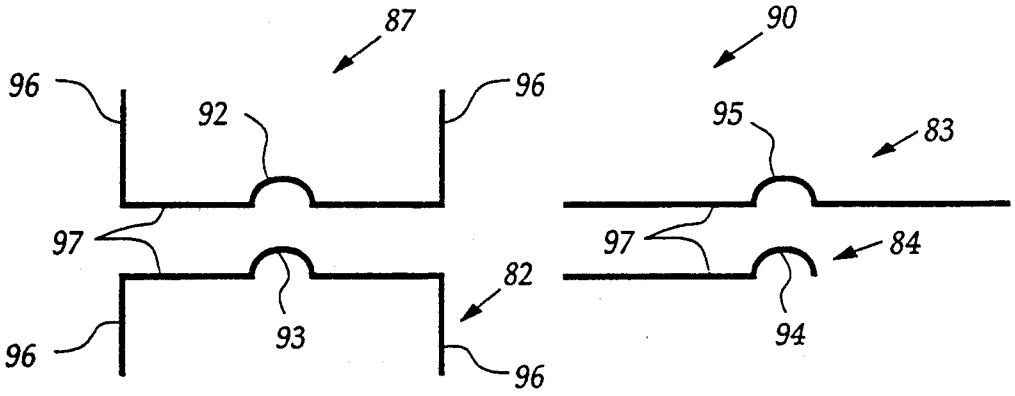
FIG. 7 is a diagrammatic sectional view of a collection of panel frame column members.

Referring to FIG. 7, four types of panel frame column members 90 are shown. The types of panel frame column member 90 are respectively a female joiner 81, a male joiner 82, a flat joiner 83 and a half joiner 84.

The female joiner 81 includes a web 91 extending between two flanges 96, and a groove 92 disposed substantially central to the web 91, the groove 92 extending longitudinally of the female joiner 81. The male joiner 82 includes a web 91 extending between two flanges 96 and having a complementary ridge 93 disposed substantially central to the web 91, the complementary ridge extending longitudinally of the male joiner 82.

The flat joiner 83 is comprised of a substantially flat web 91 having a central groove 95 substantially central to the web 91, and the central groove 95 extending longitudinally of the flat joiner 83. The half joiner 84 includes a web 91 having an edge groove 94 disposed at one edge of the web 91, the edge groove 94 and extending longitudinally of the half joiner 84.

Figure 8:
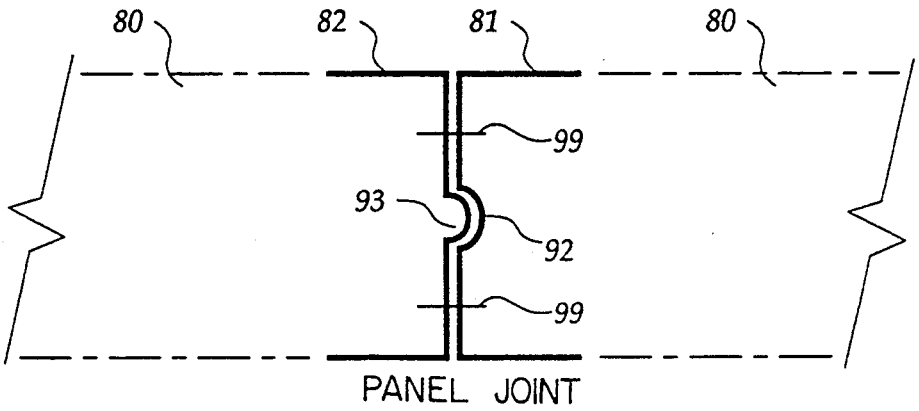
FIG. 8 is a diagrammatic sectional view of two panel frame column members joining two panels in line.

Referring to FIG. 8, two panels 80 are arranged in edge butting relationship, one panel having a female joiner 81 and the other panel 80 having a male joiner 82 on the abutting edge portions. The panels are joined by operative placement of the complementary ridge 93 on the male joiner 82 into the groove 92 of the female joiner 81 and operative placement of a pair of fasteners 99.

Figure 9:
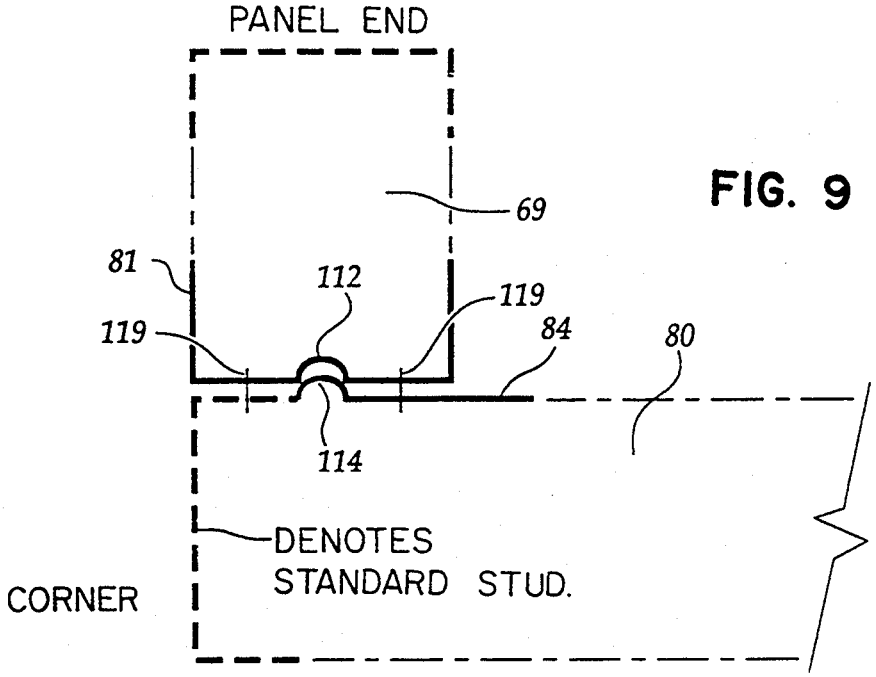
FIG. 9 is a diagrammatic sectional view of two panel frame column members joining two panels at a corner.

Referring to FIG. 9, two panels 80 are connected in edge abutting relationship about a corner. An adjoining panel 69 has a half joiner 84 attached to one side face and spaced at an appropriate distance from the end of the adjoining panel 69. The other panel 80 has a female joiner 81 on the edge adjoining the adjoining panel 69. The panel 80 and adjoining panel 69 are abutted by operative placement of the edge groove 94 on the adjoining panel 69 in the groove 92 of the panel 80. The panels are attached together by operative placement of fasteners 99 through apertures provided in the half joiner 84 and the female joiner 81. Alternatively, operative placement of the panel 80 with the adjoining panel 69 may be effected by a male joiner 82 on one edge of the panel 80 with its complementary ridge 93 engaging with the concave side of the edge groove 94 of the half joiner 84.

Figure 10:
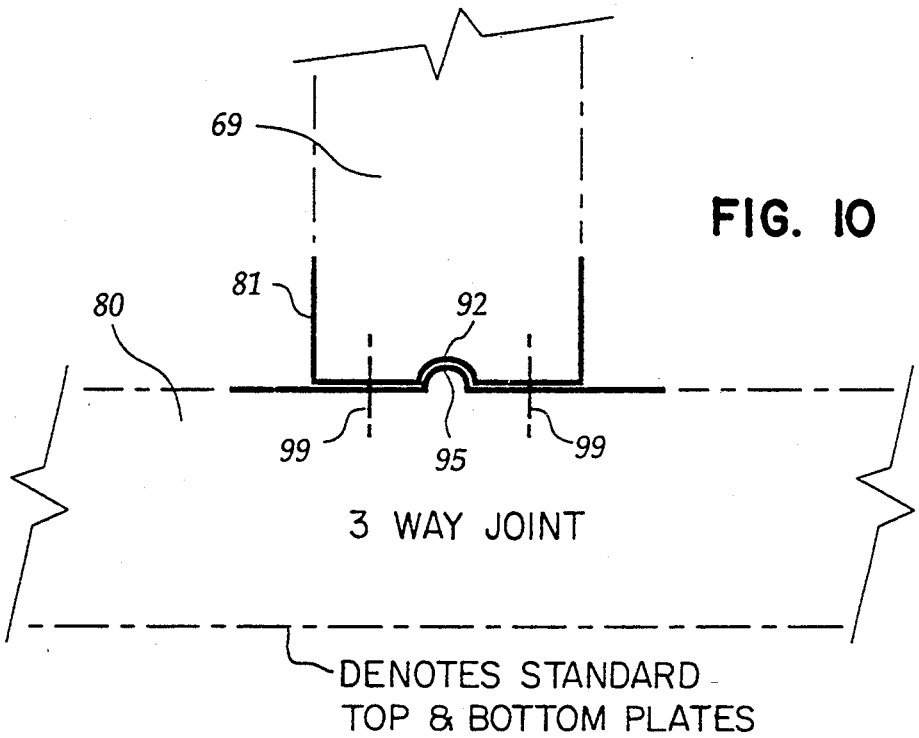
FIG. 10 is a diagrammatic sectional view of two panel frame column members joining two panels at an intersection.

Referring to FIG. 10, two panels 80 are joined at an intersection by including a flat joiner 83 on the side face of one panel 80 and a female joiner 81 on the end of an adjoining panel 69. Operative placement of the panel 80 with the female joiner 81 is with its groove 92 engaging with the convex side of the central groove 95 of the flat joiner 83. The panels are attached together by operative placement of fasteners 99 through apertures provided in the flat joiner 83 and the female joiner 81. Alternatively, operative placement of the panel 80 with the adjoining panel 69 may be effected by a male joiner 82 on one edge of the panel 80 with its complementary ridge 93 engaging with the concave side of the central groove 95 of the flat joiner 83.

Figure 11:
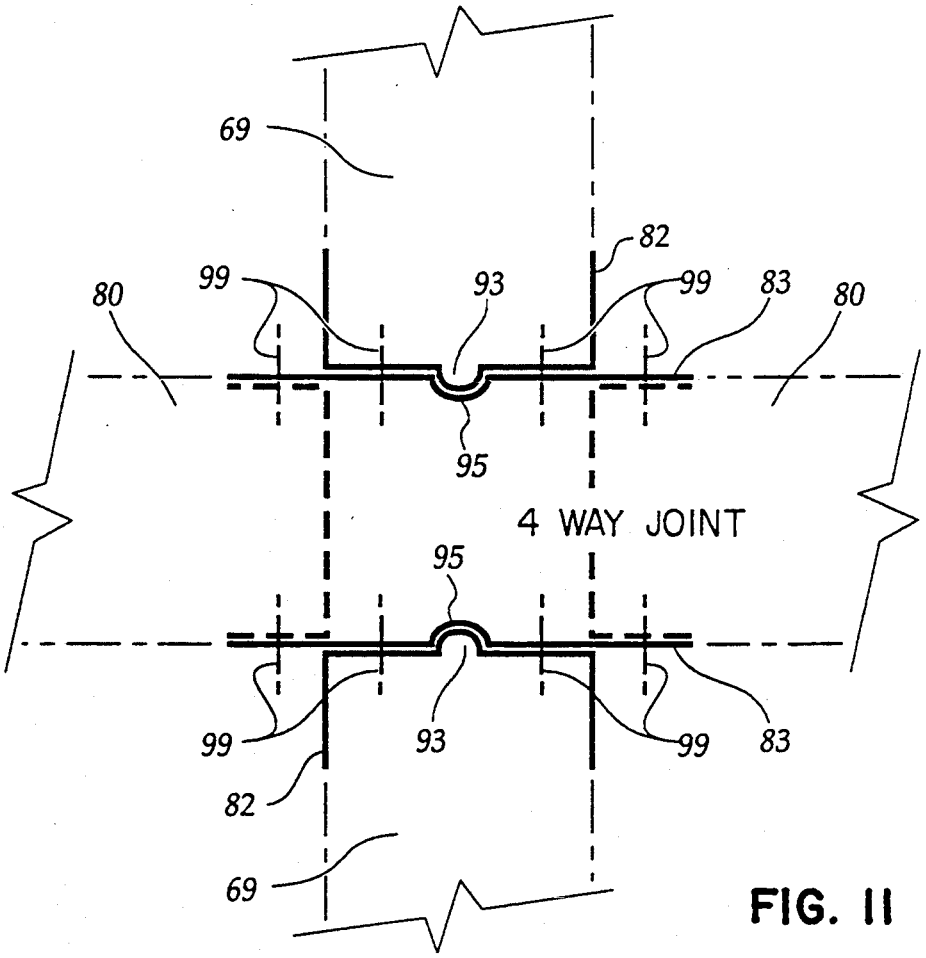
FIG. 11 is a diagrammatic sectional view of four panel frame column members joining four panels at a common intersection.

Referring to FIG. 11, four wall panels are connected at a common intersection by providing two of the wall panels 80 with a male joiner on adjacent ends of each panel 80 and operative placement of the complementary ridge 93 on each panel 80 having the male joiner 82 into the central groove 95 of the flat joiner 83 which extends between the end portions of the side faces of the two adjoining panels 69. The panels are attached together by operative placement of fasteners 99 through apertures provided in the flat joiners 8 and the male joiners 6. Alternatively, operative placement of the panels 80 with the adjoining panels 69 may be effected by a female joiner 81 on one edges of the panels 80 with their grooves 92 engaging with the convex sides of the central grooves 95 of the flat joiners 8, or further, the combination of a male joiner 82 and a female joiner 81 as desired.

Figure 12:
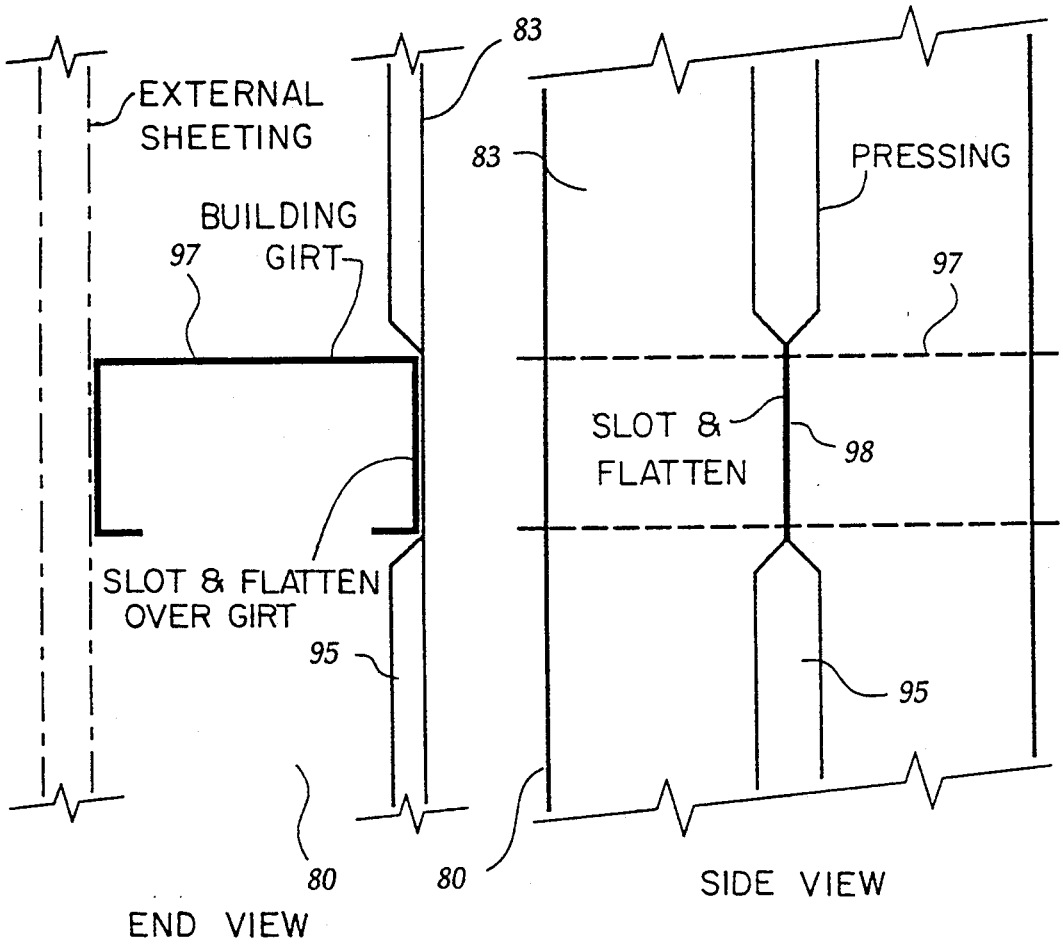
FIG. 12 is a collective side and end view of a panel frame column member for fixing sheet material to a panel.

Referring to FIG. 12, a wall panel 80 having a building girt 97 has a flat joiner 83 extending from the top of the panel 80 to its base to afford greater strength to external sheeting which may be applied to the panel 80. The central groove may be flatten in the region of flange of the building girt 97 by providing a slot 98 in the central groove 95 and flattening the central groove 95 so that the flat joiner 83 may traverse the building girt 97 so as to be substantially planar.

The female joiner 81 and/or the male joiner 82 may also include a lip on the flanges 96 of the type disclosed in relation to FIGS. 10 and 12, so that in use, the panel frame column members 90 may be boxed sections.

In use, a first wall panel having horizontal studs may be formed either on site or as prefabricated frames, and joined to a second wall panel by applying fasteners to the vertical posts at one end of the second wall panel through selected ones of the horizontal studs of the first wall panel. It is believed that the increased number of connection points in the completed joint may provide increased strength and/or stiffness to the joint so constructed.

Wall panels having vertical studs may be constructed having a female joiner as a panel frame column member on one end and a male joiner as a panel frame column member on the opposite end vertically disposed between the top and the bottom of the panel. Other column members or studs may be disposed at intervals along the panel in a vertical orientation extending between the top and the bottom of the panel as appropriate, and noggins may be provided between such studs. Sheeting may be provided on one or both side faces of the frame so constructed to provide a column effectively having a groove extending vertically and centrally along one end of the panel and a complementary ridge extending vertically and centrally along the other end of the panel.

It is preferred that sheeting is not provided on the panels frames until after the frame has been assembled into the finished structure as desired. Panel frames may be joined together by first aligning them and then fixing them together with bolts, rivets or the like through apertures provided in the web of the panel frame column members.

Two panels may be joined together by aligning the complementary ridge of one panel into the groove of an adjoining panel, the provision of the locating means the groove and complementary ridge affording ease of assembly by a single operator.

Where one wall is to intersect another, a flat joiner may be bolted to the frame having its central groove 95 directed convexly outwards of the face of the panel at any position therealong independently of the position of studs and or columns. The flat joiner, once positioned is fastened to the panel frame by fasteners fastened through apertures pre-punched or drilled into the flat joiner and through apertures drilled, pre-drilled, punched or pre-punched into the stringers, noggins or girts. Another panel may be aligned up so that the convex or concave side of the central groove engages with the groove or complementary ridge respectively on the end of the adjoining panel. The two panels are fastened by operative placement of fasteners as hereinbefore described.

Where there is to be a four way intersection of adjoining panels, two panels in substantial alignment in one direction are first provided with flat joiners on the adjacent edges so that either the groove or the complementary ridge of the panels engages with the appropriate side of the central groove of the flat joiner. Once one of the panels provided with the flat joiner is placed in position, the panels crossing the intersection may be attached thereto by operative placement of fasteners through the edges of the flat joiner to the side faces of the crossing panels the appropriate distance from the ends of the adjoining panels adjacent the intersection.

Where extra strength of the sheeting and/or panel frame is required, a flat joiner may be provided by bolting same between the top and bottom stringers of the panel and having the central groove flattened by providing a slot in the vicinity of the position where flattening is required such as at the bottom stringer, the top stringer and a central girt or noggin. Preferably the sheeting is applied after the panel frames have been erected into their respective positions and assembled into the desired configuration for the frame of the structure.

Figure 13:
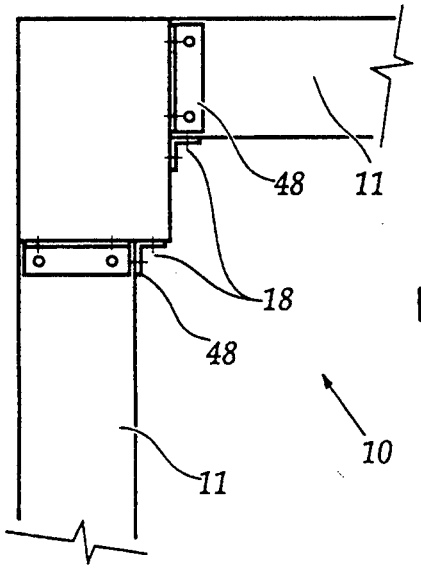
FIG. 13 is a view of an alternative embodiment of an external wall construction shown in FIG. 1.

As shown in FIG. 13, where a wall frame 15 intersects with another at a corner, it is fastened thereto by providing strips of angle 48 for fastening to the respective flange portions of the respective horizontal studs 11 through respective flange fastenings 18. This method of connection does not therefore require a vertical post 12 at the intersection and may be used for both internal and external walls. An intersection portion 49 of the horizontal stud 12 has one flange flattened out substantially planar with the web and a web fastening 17 is provided through the respective overlying webs.

Figure 14:
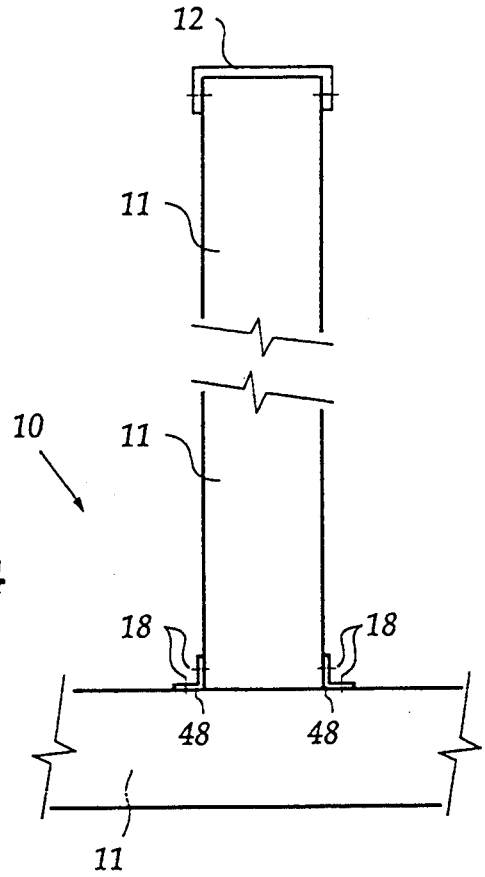
FIG. 14 is a view of an alternative embodiment of an internal wall construction shown in FIG. 13.
Figure 15:
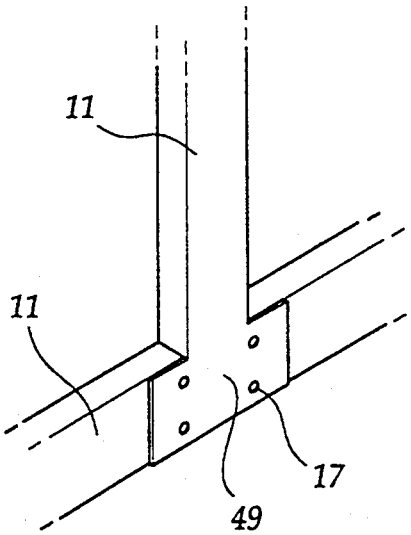
FIG. 15 is a diagrammatic view of the connection details of the wall constructions shown in FIGS. 13 and 14.

As shown in FIGS. 14 and 15, where a wall frame 15 intersects with another at a terminating intersection, it is fastened thereto by providing strips of angle 48 for fastening to the respective flange portions of the respective horizontal studs 11 through respective flange fastenings 18. For the same reason as described in relation to FIG. 13, this method of connection does not therefore require a vertical post 12 at the intersection and may be used for both internal and external walls. An intersecting portion 49 of the horizontal stud 12 has both flanges flattened out substantially planar with the web and a web fastening 17 is provided through the respective overlying webs. Additionally, the vertical post 12 may be comprised of a pair of angles 48 fastened to the respective ends of the horizontal studs 11.

Figure 16:
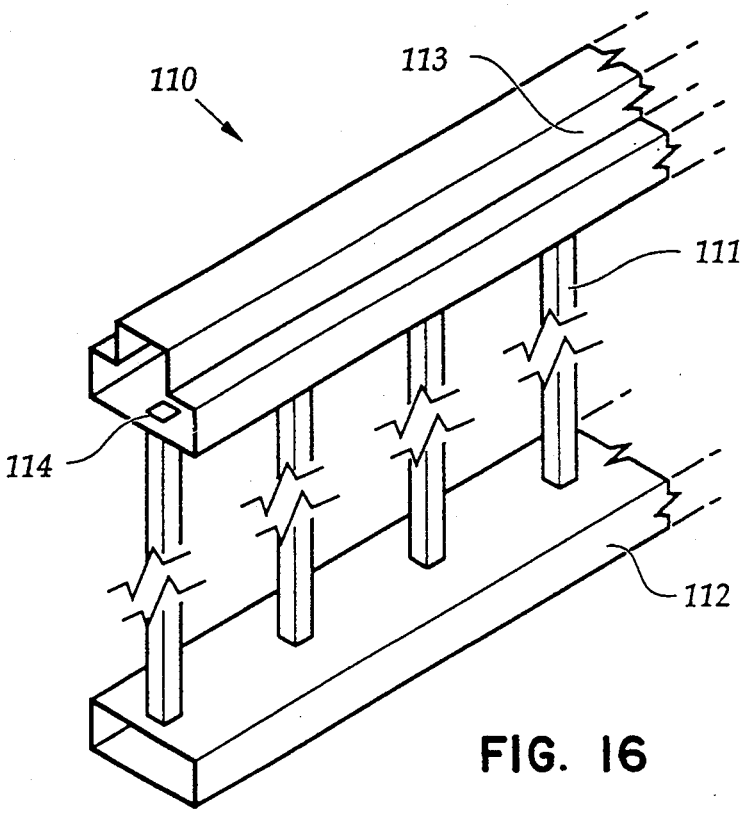
FIG. 16 is a diagrammatic representation of a portion of balustrade.
Figure 17:
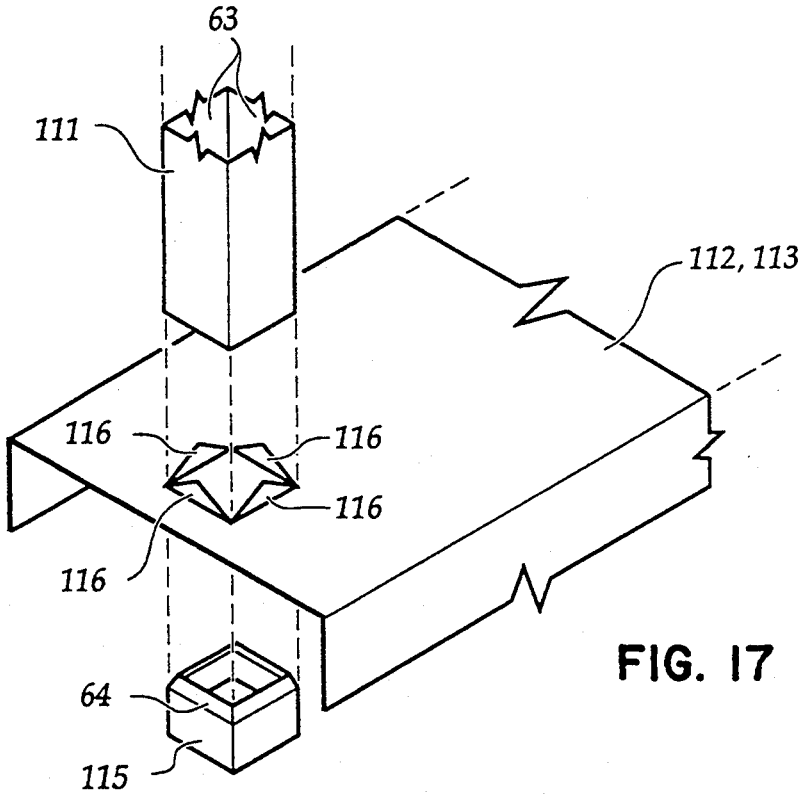
FIG. 17 is an exploded view of a portion of balustrade showing the connection of a baluster to a rail, and FIGS. 18*a*, 18*b*, and 18*c* collectively shows alternative embodiments for a balustrade top rail.

Referring to FIG. 16, a balustrade 110 has a plurality of balusters shown typically at 111 extending between a bottom rail 112 and a top rail 113. Each baluster 111 is engaged about an aperture 114 which is shown in more detail in FIG. 13.

Referring to FIG. 117, the baluster 111 is fixed to a top rail 113 or a bottom rail 112 by engagement of its inner surface 63 with respective tongues 116 formed in the creation of the aperture 114. A gripping plug 115 having an outside dimension comparable with the dimensions of the aperture 114 may be inserted into the aperture 114 once the baluster 111 is operatively placed over the aperture 114 is surrounding engagement with the tongues 116.

The gripping plug 115 has a sharpened leading edge 64 formed so that its engaging face engages with the proximal edges of the tongues 116 and, upon operative placement of the gripping plug 115, the baluster 111 is held in place with respect to the top rail 113 and/or bottom rail 112 by swaging and/or interference fit of the gripping plug 115.

The gripping plug 115 and/or the baluster 111 may resiliently deform to tightly clamp the tongue 116 between the outer surface of the gripping plug 115 and the inner surface 63 of the baluster 111.

Referring to FIG. 18, a top rail 113 includes an upper channel 117 and a lower channel 118 connected together by any means. In the examples shown, the top rail 113 is assembled into a unit by the engagement of a spline member 60 about a lip 61 running along the longitudinal edge of the upper channel 117 and a complementary lip 62 running along the longitudinal edge of the lower channel 118. Alternatively, the upper channel 117 and the lower channel 118 may be fastened together by a fastener 119 which may be a nut, bolt, rivet, pop-rivet, or such like.

Alternatively, the upper channel 117 may be joined with the lower channel 118 by welding, gluing or such like.

In a preferred form, the head rail and the base rail of the balustrade are formed from a pair of opposed channels joined together about their peripheral edges in a manner similar to that described in relation to FIGS. 4, 5 & 6.

In use, a balustrade of this invention may be constructed on site or prefabricated off-site. For on-site construction, transport of the raw materials to the site may be more efficiently carried out by forming the channels for the top rail and bottom rail from galvanized steel having a form which permits the respective channels to be stacked in one another.

The balusters may also be stacked within the concavity of the stacked C-channel sections. Thus, the unassembled balustrade is economical in its demand for space for both transport and storage.

The apertures for connecting the balusters to the head rail and base rail may be pre-formed prior to delivery, or altneratively, a punch may be provided for creating the apertures in the relevant channel sections on site at desired interval spacings.

The balusters may be placed over the tongues of one rail and secured in position by operative placement of the gripping plug by use of a hammer or other plug fixing implement such as an air gun or the like.

The other rail member is placed over the other ends of the balusters so that they engage with the tongues protruding from the channel for each respective baluster. The gripping plug is then placed in its operative position for each respective baluster in a similar manner to that carried out for the other C-channel section.

The other member of the pair for each rail is operatively placed for engagement with its first pair member and operatively joined together by placement of the joining means employed to construct the hollow section rail.

For the longitudinal spline joining means, the longitudinal spline is placed with one end against the end of the rail about the respective lips of each channel and put into position by either hammer blows or application of force.

Where a bulkhead member is required, this may be fixed to a first channel member and then the other channel member aligned and connected to the first channel member by the spline member. The bulkhead member may then be fixed to the other channel member. Alternatively, the bulkhead members may be adapted to fit tightly within the box section formed from the lipped channel members, and be operatively placed therein by operative placement of spline members having an appropriate length. The bulkhead members may fixed by screwing, gluing, welding and such like but preferably the bulkhead member os riveted to the respective channel members.

Whilst not limiting the generality of the invention, it is believed that an advantage of the present construction is that it may be formed from conventional components, most of which are readily available and only a small amount of fabrication work is required on site and is of a very simple nature. Furthermore, all of the parts may be pre-manufactured, including bolt apertures, such that the structure can be assembled from the common components without the requirement for specialised components for each connection. Moreover, metal parts may be joined together without on site welding, permitting metal parts to retain the integrity of any galvanising or other surface treatments. A further advantage of the present invention is that components may be provided in lengths suitable for containerization for ease and economy of transport.

It will of course be realised that the above has been given only by way of illustrative example of the invention and that all such modifications and variations thereto as would be apparent to persons skilled in the art are deemed to fall within the broad scope and ambit of the invention as is defined in the appended claims.

I claim:

1. Steel framing for a building construction having a roof structure including inclined roof frame members and perimeter supporting posts, characterised in that:

said posts and said roof structure are formed from steel sections;

the connections between the perimeter supporting posts and the roof structure are formed by separate connector assemblies each having post mounting brackets enabling each connector to be mechanically fastened to the top of a respective said perimeter supporting post and roof frame mounting brackets enabling each connector to be bolted to a respective inclined roof frame member extending inwardly from the respective perimeter posts, said posts being formed as box-like members and each said connector assembly including a spigot/socket mounting extending into/over the end of a post and forming said post mounting bracket associated with said connector assembly, an upstanding, plate-like roof frame mounting bracket against which a side face of the inclined roof frame member may extend; an upstanding, plate-like perimeter frame mounting bracket against which a side face of the perimeter frame member may extend, and said plate-like mounting brackets having detachable mounting members thereon for selectively attaching mounting brackets thereto for supporting extension frames adapted to support a roof portion externally from said perimeter posts, said connector assemblies also having perimeter beam mounting brackets enabling adjacent perimeter posts to be interconnected by perimeter beams mechanically fastened to said perimeter beam mounting brackets.

2. Steel framing as claimed in claim 1, wherein said roof frame mounting brackets is so formed that said frame member or a frame extension member extends over and beyond the post.

3. Steel framing as claimed in claim 1, wherein the mounting brackets of said connector assembly are each provided with at least two spaced apertures and the building construction elements mechanically fastened thereto are correspondingly apertured to permit mechanical fastening by bolting and forming moment transferring connections between said building construction elements and said connector assembly.

4. Steel framing for a building construction having a roof frame structure including inclined roof frame members and perimeter supporting posts formed from steel sections, characterised in that:

said perimeter supporting posts are formed as box-like members and the connections between the perimeter posts and the roof frame structure are formed by separate connector assemblies, each including:

a post mounting bracket enabling said connector assembly to be mechanically fastened to the top of a respective said perimeter post and having a spigot or socket mounting extending into or over an end of a respective said perimeter post, and an upstanding plate-like roof frame mounting bracket enabling each connector assembly to be bolted to a side face of a respective said inclined roof frame member extending inwardly from said perimeter post, and an upstanding plate-like perimeter beam mounting bracket enabling adjacent perimeter posts to be interconnected by perimeter beams mechanically fastened to said perimeter beam mounting brackets, said plate-like perimeter frame mounting bracket including mounting means enabling selective attachment of an extension frame mounting bracket thereto, whereby a respective roof frame extension member may be supported to extend outwardly from said perimeter post above said roof frame member.

5. Steel framing as claimed in claim 4, wherein said roof frame mounting bracket extends inwardly from an outer face of the respective perimeter post whereby external cladding may extend upwardly beyond the perimeter posts alongside said roof frame mounting bracket.

6. Steel framing as claimed in claim 4, including external, spaced horizontally extending top, bottom and intermediate frame members extending between adjacent perimeter posts and cladding secured to opposite sides of said horizontal frame members.

7. Steel framing as claimed in claim 4, wherein the mounting brackets of said connector assembly are each provided with at least two spaced through-bolting apertures.

8. Steel framing as claimed in claim 7, wherein the said roof frame mounting bracket is elongated in the direction of the roof frame to be connected thereto and said perimeter beam mounting bracket extends above the upper edge portion of said roof frame mounting bracket and transversely thereto.

9. Steel framing for a building construction having a roof frame structure including inclined roof frame members and perimeter supporting posts formed from roll formed steel sections, characterised in that:

said perimeter supporting posts are formed as box-like members and the connections between the perimeter posts and the roof frame structure are formed by separate connector assemblies each including:

a post mounting bracket enabling each connector assembly to be mechanically fastened to the top of a respective said perimeter post and having a spigot or socket mounting extending into or over an end of a respective said perimeter post, and an upstanding, plate-like roof frame mounting bracket enabling each connector assembly to be bolted to a side face of a respective inclined roof frame member extending inwardly from the respective perimeter posts, and an upstanding, plate-like perimeter beam mounting bracket enabling adjacent perimeter posts to be interconnected by perimeter beans mechanically fastened to said perimeter beam mounting brackets, each said perimeter post being a composite elongated hollow member formed from opposed lipped channel members arranged with the respective spaced lips of one lipped channel member opposing the spaced lips of the other lipped channel member and connected by connecting means interconnecting said opposing lips and by the respective said connector assembly.

10. Steel framing as claimed in claim 9, wherein respective, opposing lips are interconnected by a channel shaped spline slid over said lips.

* * * * *